US010634367B2

(12) United States Patent
De' Longhi et al.

(10) Patent No.: US 10,634,367 B2
(45) Date of Patent: Apr. 28, 2020

(54) PORTABLE AIR CONDITIONER

(71) Applicant: DE' LONGHI APPLIANCES S.R.L. CON UNICO SOCIO, Treviso (IT)

(72) Inventors: Giuseppe De' Longhi, Treviso (IT); Ivano Callegaro, Vedelago (IT); Stefano Vit, Sesto Al Reghena (IT)

(73) Assignee: DE' LONGHI APPLIANCES S.R.L. CON UNICO SOCIO, Treviso (IT)

( * ) Notice: Subject to any disclaimer, the term of this patent is extended or adjusted under 35 U.S.C. 154(b) by 12 days.

(21) Appl. No.: 15/751,148

(22) PCT Filed: Aug. 5, 2016

(86) PCT No.: PCT/IB2016/054740

§ 371 (c)(1),
(2) Date: Feb. 7, 2018

(87) PCT Pub. No.: WO2017/025877

PCT Pub. Date: Feb. 16, 2017

(65) Prior Publication Data

US 2018/0238566 A1 Aug. 23, 2018

(30) Foreign Application Priority Data

Aug. 7, 2015 (IT) ..... 10215000043339

(51) Int. Cl.

| | |
|---|---|
| ***F24F 1/04*** | (2011.01) |
| ***F24F 1/022*** | (2019.01) |
| ***F25B 6/04*** | (2006.01) |
| ***F25B 40/02*** | (2006.01) |
| ***F25B 40/04*** | (2006.01) |
| ***F25D 3/06*** | (2006.01) |

(52) U.S. Cl.

CPC ..... *F24F 1/04* (2013.01); *F24F 1/022* (2013.01); *F25B 6/04* (2013.01); *F25B 40/02* (2013.01); *F25B 40/04* (2013.01); *F25D 3/06* (2013.01); *F24F 2221/12* (2013.01)

(58) Field of Classification Search

CPC .... F24F 1/04; F24F 1/022; F24F 1/025; F24F 3/001; F24F 2221/12; F25D 3/06; F25B 6/04; F25B 40/02; F25B 40/04; F25B 25/005; F25B 27/00; F25B 49/02; F25B 49/027; F25B 1/10; F25B 13/00

See application file for complete search history.

(56) References Cited

U.S. PATENT DOCUMENTS 4,197,716 A * 4/1980 Nussbaum ..... F25B 13/00 62/196.4
5,031,690 A 7/1991 Anderson et al.
(Continued)

FOREIGN PATENT DOCUMENTS

| | | |
|---|---|---|
| EP | 1 068 967 A1 | 1/2001 |
| FR | 2 305 699 A1 | 10/1976 |
| FR | 2 439 371 A1 | 5/1980 |

OTHER PUBLICATIONS

International Search Report and Written Opinion for PCT/IB2016/054740, dated Nov. 11, 2016.

*Primary Examiner* — Emmanuel E Duke
(74) *Attorney, Agent, or Firm* — Marshall, Gerstein & Borun LLP

(57) ABSTRACT

Portable air conditioner provided with an external container comprising internally a refrigerating circuit provided with a condenser.

14 Claims, 3 Drawing Sheets

(56) References Cited

U.S. PATENT DOCUMENTS

| | | | | |
|---|---|---|---|---|
| 5,964,098 | A * | 10/1999 | Huang | F25B 40/04 62/279 |
| 2005/0028545 | A1 | 2/2005 | Hebert | |
| 2011/0219817 | A1 * | 9/2011 | Esaki | F25B 39/04 62/512 |
| 2015/0267946 | A1 * | 9/2015 | Lowstuter, Jr. | F25B 27/005 62/235.1 |

* cited by examiner

PORTABLE AIR CONDITIONER

FIELD OF THE INVENTION

The present invention concerns a perfected portable air conditioner, in particular a portable air conditioner of the domestic type, or rather for a single room.

In particular, the present invention concerns portable air conditioners that do not require installations that expel the hot air produced in them by means of a hose or other toward the outside of the room.

BACKGROUND OF THE INVENTION

It is known that there is a cooling plant in every portable air conditioner, and it is also known that the cooling gases coming from the compressor must then be cooled in a condenser so that, during evaporation, they are able to absorb heat and thus allow the air conditioner to perform its function.

By conditioners here we mean in particular domestic conditioners, or for rooms, more advantageously we mean portable air conditioners as indicated above.

In this type of conditioner, it is important to obtain the best performance without having to increase the external sizes of the conditioning unit, and indeed doing as much as possible to reduce it, since in any case the conditioner constitutes an encumbrance.

In cooling plants for this type of conditioner, the temperature of the cooling gases that enter the condenser is on average around 70° C., while exiting from the condenser the temperature is around 55° C. The air exiting from the condenser has a temperature around 50° C. and is sent outside by means of a suitable hose or other suitable system.

In the state of the art, some solutions are known concerning small air conditioning devices in which solutions have been used to improve cooling efficiency of a compression cooling cycle.

U.S. Pat. No. B5,031,690 describes a portable air conditioner for cooling an aircraft when it is on the ground, which provides a refrigerating circuit comprising two condensers connected in parallel with respect to the circuit of the cooling fluid. Each condenser, due to the position it assumes in the circuit, is hit by a different and distinct stream of air, because the two condensers are disposed co-planar with respect to each other. This solution does not allow to reduce the absolute condensation pressure, nor therefore the compression work, so that the increased efficiency obtained is limited.

The patent application US-A-2005/0028545 describes a refrigerating circuit to be applied to a conditioning plant for a civil structure which, in one embodiment, provides a pre-cooler located in series and upstream of the condenser. In this case too, due to their reciprocal position in the circuit, the stream of air that hits the pre-cooler is not the same that hits the condenser, and therefore the desired increase in efficiency is not obtained in terms of reducing the compression work.

Due to the circuit configuration the system described here is not suitable for use in a portable air conditioner for domestic use.

The patent application EP-A-1,068,967 describes a refrigerating circuit for an air conditioning apparatus for a motor vehicle that provides a condenser preceded by an auxiliary exchanger. In correspondence with the auxiliary exchanger a heat exchanger is provided between two liquid substances.

Therefore, in this case too no single stream of air is provided that exchanges heat first with the condenser and then with the auxiliary exchanger.

These prior art documents describe applications of a refrigerating circuit that do not allow to solve the problems found in a domestic portable air conditioner, in which there is a need to improve the efficiency of the refrigerating circuit considering the limits imposed by the bulk, weight and industrialization requirements of the production process.

The patent application FR-A-2,305,699 describes perfected installations that provide a heat pump circuit. The heat pump circuit provides a recovery exchanger connected in series to the condenser, both are hit by a stream of air and with respect to this the recovery exchanger is located upstream of the condenser.

The patent application FR-A-2,439,371 describes a heat pump circuit with heat exchange between two liquid substances. The circuit does not provide the presence of an auxiliary exchanger connected to the condenser.

The present Applicant has studied the problem of increasing the efficiency of cooling units for this type of portable air conditioner, maximizing the heat exchange between the air and the coolant before the coolant enters the condenser, without requiring an increase in the external sizes of the conditioner, and indeed possibly reducing them, hence without modifying the bulk and external shape of the portable air conditioner.

He has also studied the problem of increasing the efficiency of cooling units without modifying the sizes and conventional position of current components, and thus being able to keep substantially unchanged the structure and internal configuration of conditioners currently produced.

The purpose of the present invention is therefore to improve the performance of a cooling unit for portable air conditioners of the type identified above, without affecting the external sizes and geometry of the conditioner and the configuration and disposition of the internal components.

Another derived purpose is to apply this improvement to portable air conditioners already on the market as well, with a limited modification in the production line and with a limited expense, increasing their thermal yield.

Another purpose is to increase the cooling power obtained, with the same power absorbed by the machine.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

According to the invention, the portable air conditioner provides, in association with the conventional condenser normally present in conditioners of this type, a temperature reducer, or auxiliary exchanger, for the cooling gas, so that the cooling gas fed by the compressor also passes in the auxiliary exchanger, as well as in the condenser, before reaching the throttling member.

In one solution of the invention, by auxiliary exchanger we mean a de-superheater, which lowers the temperature of the heated cooling gas immediately after it has been compressed. This reduction in the temperature of the cooling gas exiting from the compressor before it enters the condenser allows to reduce the absolute condensation pressure, which advantageously leads to a reduction in the work performed by the compressor. Therefore, the power absorbed by the compressor will be less, thus allowing an increase in the cooling efficiency of the portable conditioner.

According to one aspect of the present invention, the auxiliary exchanger is located, in the refrigerating circuit, in direct proximity to the condenser, so that the same hot gas circuit passes through the auxiliary exchanger and condenser which are hit by the same stream of air.

In a preferred solution, although not restrictive, the auxiliary exchanger has smaller sizes than the condenser and is positioned in the refrigerating circuit in a position completely contained in the bulk of the condenser, so that the stream of air that passes through the condenser necessarily hits the whole body of the auxiliary exchanger, thus improving the cooling efficiency.

Furthermore, advantageously, to generate said stream of air a single device is sufficient, thus avoiding the need to install a dedicated device respectively for the condenser and the auxiliary exchanger. This leads to a reduction in costs of production engineering, supply of components and production, as well as optimizing the efficiency of the portable conditioner.

A variant provides that the auxiliary exchanger is a heat exchanger.

Another variant provides that the heat exchanger remains autonomous even if combined, associated or integrated in the condenser.

Another variant provides that the auxiliary exchanger is limited in size, which strategy makes it possible to combine it with the condensers present in portable conditioners already on the market, on sale or sold, increasing their performance with the same power absorbed.

Furthermore, the limited size of the auxiliary exchanger allows the stream of air, once it has passed through the condenser, to completely hit the auxiliary exchanger, so as to maximize the heat exchange between the stream of air and the hot gas passing through.

This therefore leads to a reduction in temperature of the hot gas entering the condenser of about 10° C., compared with the state of the art.

In a variant embodiment, the auxiliary exchanger is located upstream of the condenser in the hot gas circuit.

A variant provides that the auxiliary exchanger is located upstream of the ventilator that operates on the condenser.

Another variant provides that the cooling air transits first through the condenser and then through the auxiliary exchanger.

It is obvious that the position of the auxiliary exchanger, in the event of intervention with conditioners already present because they have already been sold or are to be sold on the market, will be conditioned by the spaces available and by the path of the air already present or modifiable. In this case the auxiliary exchanger might not be parallel to the condenser but will remain in the stream of cooling air.

It should be noted that, in order to further increase its contribution, the auxiliary exchanger could cooperate with drops of water or damp source, which continuously or periodically affect it.

Another variant provides that the condenser has a single body, but passed through by two circuits located in sequence.

According to one embodiment of the invention, the pipes which the cooling gas of the condenser passes through and those of the auxiliary exchanger have different or identical sections, such as circular or oval, said sections possibly having an identical transit area.

According to a variant, the pipes of the condenser and those of the auxiliary exchanger have different sections in terms of shape and/or sizes.

Advantageously, the pipes of the condenser and of the auxiliary exchanger have heat disposal means and/or means to accentuate the heat exchange, such as fins, microchannels, lines or suchlike.

According to one embodiment of the present invention, the heat disposal means of the condenser and the auxiliary exchanger have identical characteristics and/or position with respect to the cooling gas pipes, or at least very similar characteristics.

According to a variant, the heat disposal means of the condenser and the auxiliary exchanger have different characteristics and/or position, so as to generate a different heat exchange effect.

According to one embodiment of the invention, the stream of air that passes through the condenser at a temperature around 30-35° C., and at exit from the condenser has a temperature of about 45° C., is then made to transit through the auxiliary exchanger. This allows to lower the temperature of the cooling gas exiting from the condenser by around 10° C. or more.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

The present invention concerns a portable air conditioner of the type in question, provided with an external container.

The external container is configured to have sizes adequate to comprise inside it a refrigerating circuit 10 and the components connected to it.

Figure 1:
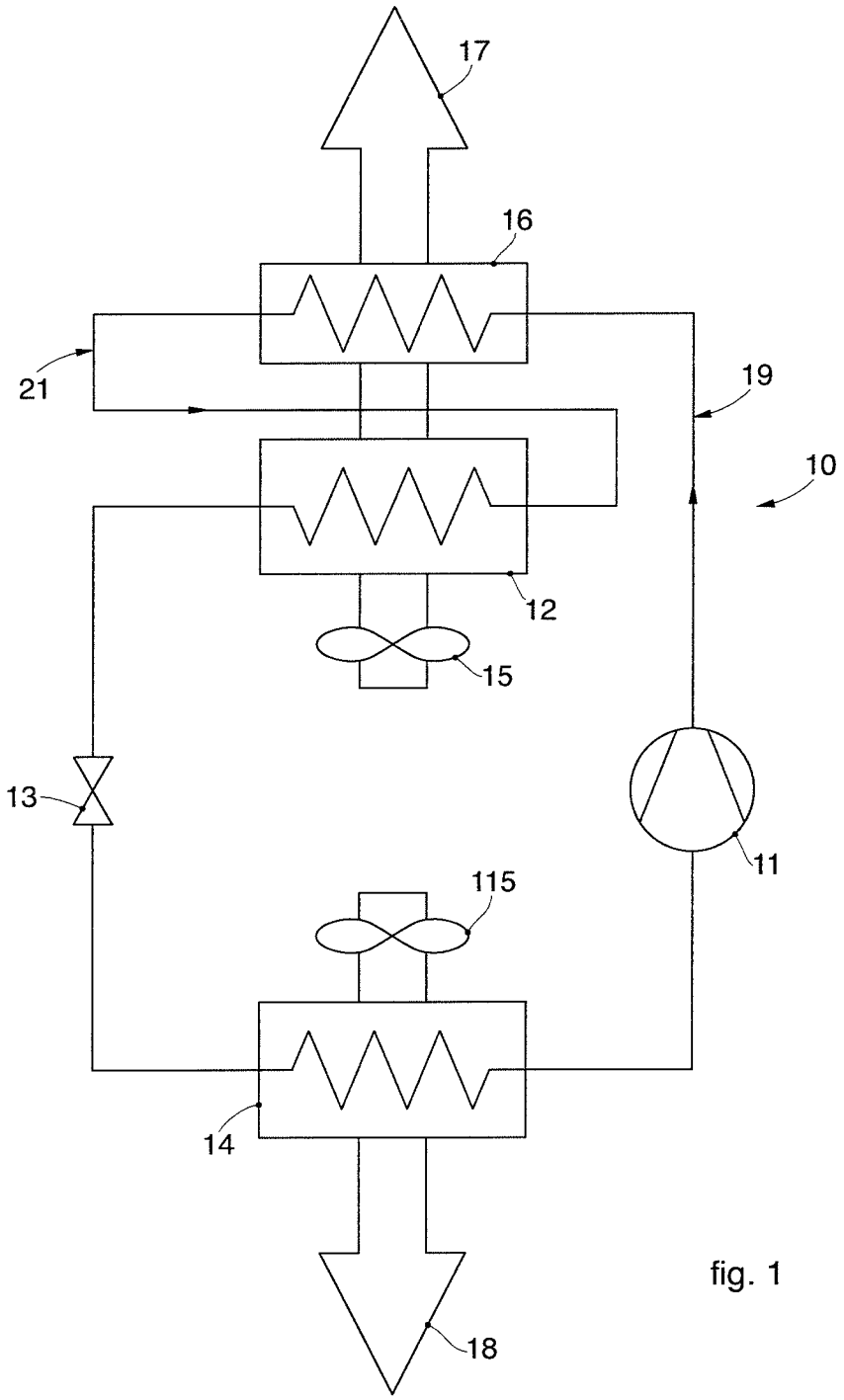
FIG. 1 is a schematic illustration of the basic evolution and the case where it is integrated in existing plants.

FIG. 1 shows by way of example a refrigerating circuit 10 present in a portable air conditioner, where the refrigerating circuit 10 has an auxiliary exchanger 16 according to the perfected form of the invention.

In the case of FIG. 1, the hot gas exiting from an evaporator 14 enters a compressor 11 that compresses it and sends it to a remaining circuit of hot gas 19.

Unlike in the state of the art, according to the invention, the hot gas 19 enters the auxiliary exchanger 16 for example at about 70° C., where the temperature is slightly lowered. At exit from the auxiliary exchanger 16, the hot gas exits at about 60° C. for example.

The exit of the auxiliary exchanger 16 is directly connected to the entrance to the condenser 12 by means of a hot circuit 21 which makes it enter the condenser 12 from which it exits, for example at about 45° C., instead of, as happens with traditional solutions that do not have the auxiliary exchanger 16, at about 55° C.

Once it has exited the condenser 12, the cooling gas flows, in a conventional manner, toward an expansion member, in this case a throttling valve 13, in which it is made to expand before entering the evaporator 14.

A fan 15, driven by a motor member (not shown), sends the air 17 which in this case by way of example, passes respectively through first the condenser 12 and then the auxiliary exchanger 16.

Thanks to this circuit configuration, and to the fact that the auxiliary exchanger 16 is in close proximity to the condenser 12, downstream of it, and is hit by the same stream of air, it is possible to exploit the difference in temperature of the stream of air 17 exiting from the condenser 12 and the surface temperature of the auxiliary exchanger 16.

In fact, since the air exiting from the condenser 12 is at a temperature of about 45° C. and the surface temperature of the auxiliary exchanger 16 is about 65° C., the stream of air 17 exiting from the condenser 12 is able to cool the cooling gas that has left the compressor 11, optimizing the cooling of the cooling gas with a single stream of air 17.

This also causes a reduction in the absolute condensation pressure, to which there corresponds a reduction in the compression work by the compressor 11 and hence an increase in cooling efficiency, which is given by the ratio between cooling capacity and total electric power absorbed, expressed in watts.

Figure 4:
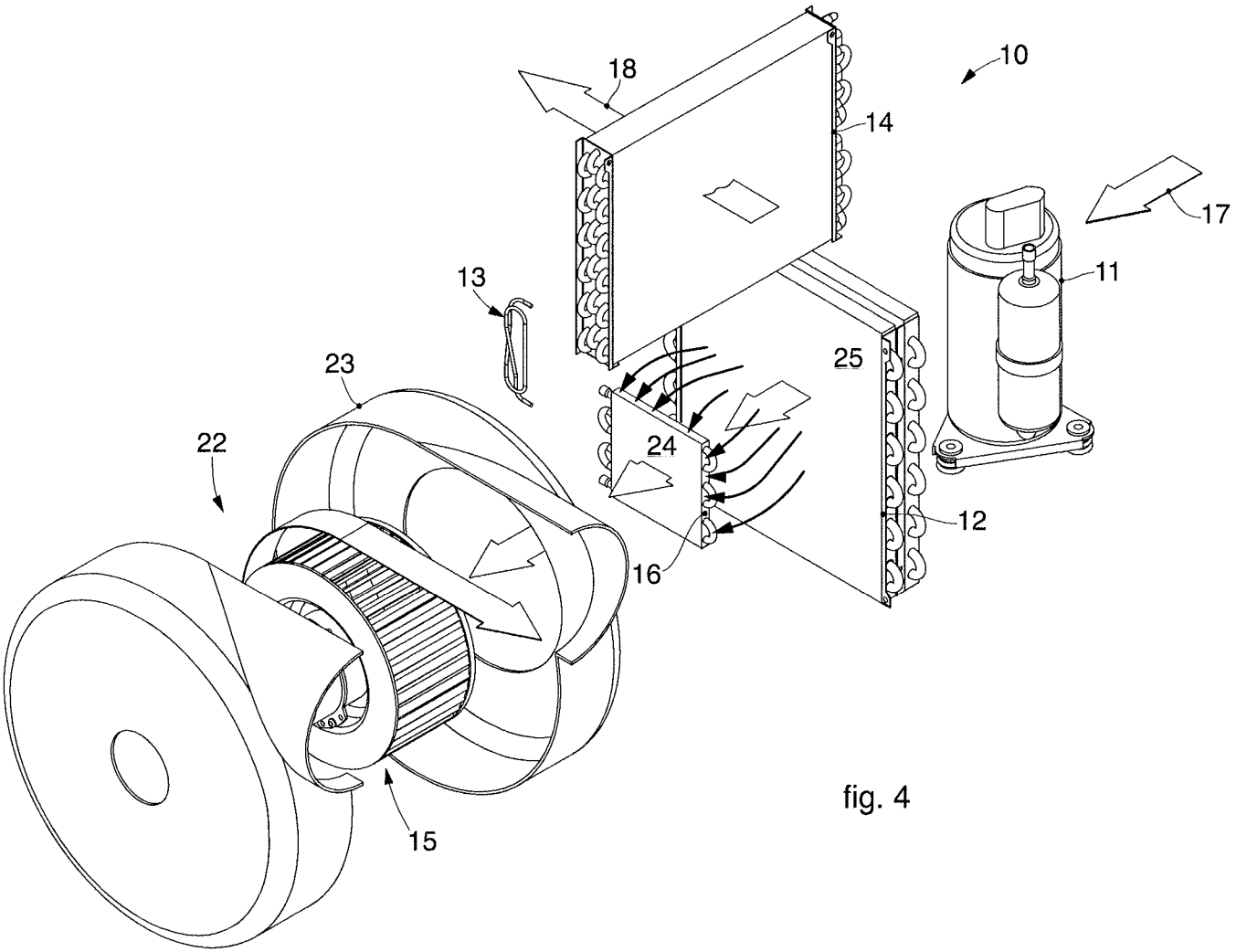
FIG. 4 is a three-dimensional view of an example installation of the auxiliary exchanger.

With reference to FIG. 4, the fan 15 can be installed inside a spiral 23 of a centrifugal ventilator 22 of a known type.

On the contrary, a fan 115 sends the air 18 through the evaporator 14 in which the expanded cooling fluid transits, and hence brings cool air with it.

Figure 2:
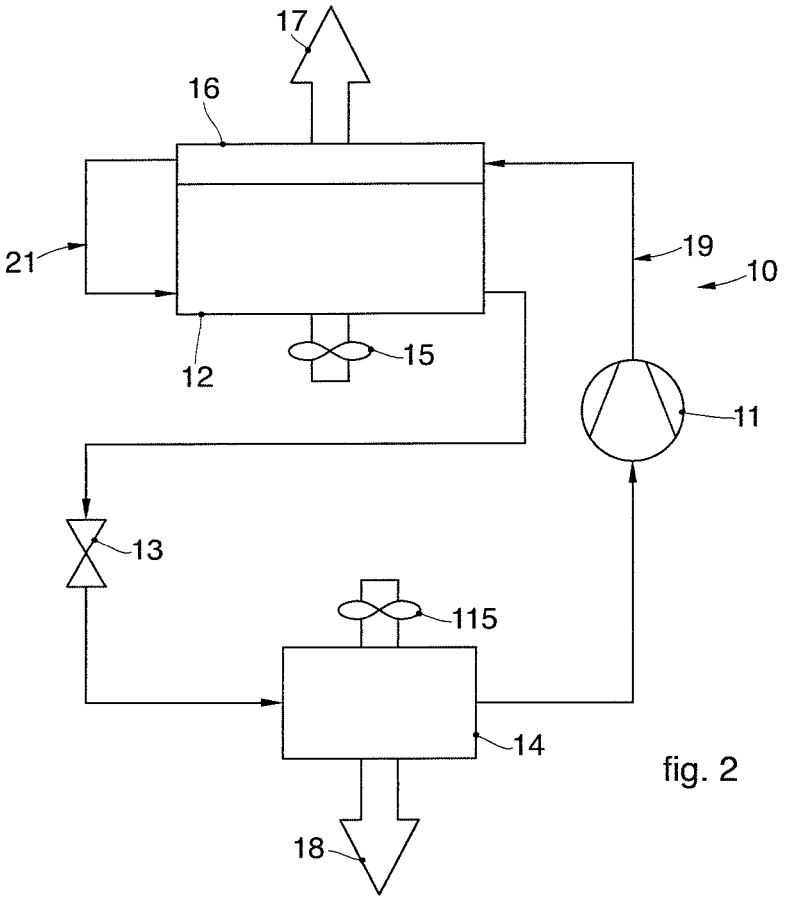
FIG. 2 is a schematic illustration of another evolution which uses two exchangers.

In the case shown in FIG. 2, the auxiliary exchanger 16 is autonomous from the condenser 12, even if the two components are combined, so that this solution can also be used to implement existing refrigerating circuits without operating on the external container.

Figure 3:
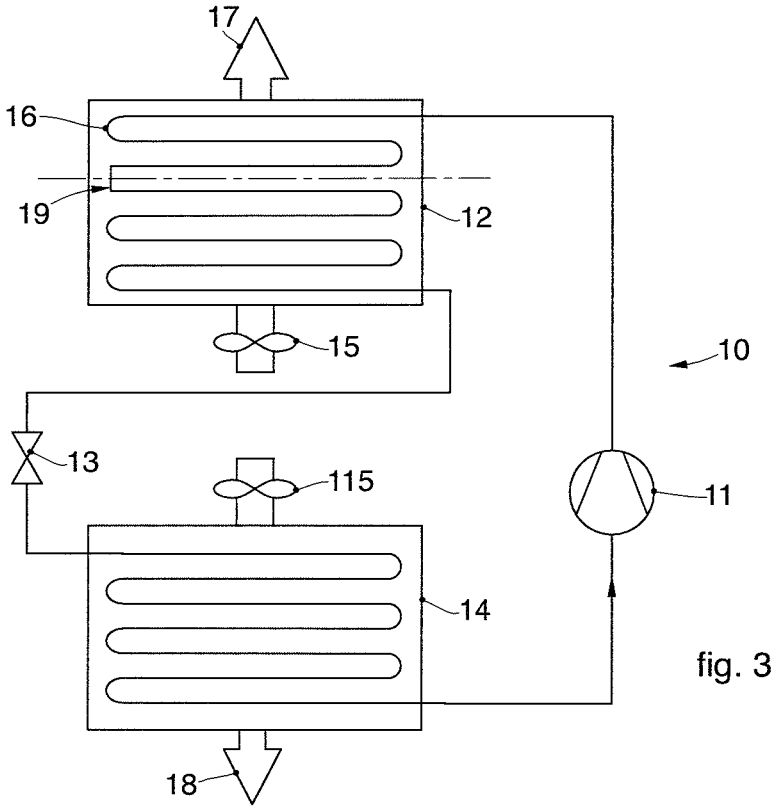
FIG. 3 is a schematic illustration of another evolution which uses two exchangers.

In the case shown in FIG. 3, the auxiliary exchanger 16 and the condenser 12 are integrated, to constitute a single unit pre-assembled during the step when the hot circuit 21 is made.

It should be noted that, in FIGS. 1 to 3, the auxiliary exchangers 16 are shown with sizes equal or nearly equal to those of the condenser 12, merely by way of example. In practice the auxiliary exchanger 16 can have any size suitable for the purpose and such that it can be easily integrated inside the external container without requiring modifications in size or design.

FIG. 4 shows an example of a possible practical application of the invention.

In this case, the stream of air 17 generated by the fan 15 cools the compressor 11, then transits through the condenser 12 and finally passes through the auxiliary exchanger 16 that has a surface 24 affected by the stream of air 17.

In a variant embodiment shown in FIG. 4, the auxiliary exchanger 16, installed between the condenser 12 and the centrifugal ventilator 22, is configured with a quadrangular shape and with the surface 24, exposed to the stream of air 17, lower than the surface 25 of the condenser 12.

The evaporator 14 is affected by a stream of air 18 generated by another fan 115, not shown in FIG. 4.

In another variant, the auxiliary exchanger 16 can be configured so that its bulk is such as to be located inside the external container without having to modify the external container.

In a variant embodiment, not shown in the drawings, the portable air conditioner can comprise a tank containing water and located in correspondence with its bottom. In this case, the auxiliary exchanger 16, in order to further increase its contribution, could cooperate with drops of water, or a damp source, which affects it.

It is clear that modifications and/or additions of parts may be made to the perfected portable air conditioner as described heretofore, without departing from the field and scope of the present invention.

For example, in variants, not shown but in any case comprised within the field of the present invention, the circuit configuration can be inverted, providing the auxiliary exchanger 16 downstream of the condenser 12 in the hot gas circuit, and upstream of the condenser 12 with respect to the stream of air 17 generated by the fan 15.

It is also clear that, although the present invention has been described with reference to some specific examples, a person of skill in the art shall certainly be able to achieve many other equivalent forms of perfected condensers for cooling plants for conditioners, having the characteristics as set forth in the claims and hence all coming within the field of protection defined thereby.

The invention claimed is:

1. A portable air conditioner provided with an external container and comprising: a refrigerating circuit having a compressor, a condenser, an expansion member and an evaporator, a fan that generates a stream of air passing through the condenser, wherein said refrigerating circuit has an auxiliary exchanger inside which a hot gas exiting from the compressor is made to circulate before being sent to the condenser for a first reduction in temperature, said auxiliary exchanger being disposed downstream relative to said condenser such that the stream of air generated by the fan hits first the condenser and then the auxiliary exchanger.

2. The portable air conditioner as in claim 1, wherein said auxiliary exchanger has a surface affected by the stream of air lower than a surface of the condenser affected by the same stream of air of said condenser.

3. The portable air conditioner as in claim 1, wherein said auxiliary exchanger is located upstream of the condenser with respect to the circuit of hot gas.

4. The portable air conditioner as in claim 1, wherein said auxiliary exchanger is located downstream of the condenser with respect to said stream of air.

5. The portable air conditioner as in claim 1, wherein said auxiliary exchanger is located upstream of a centrifugal ventilator which generates the stream of air.

6. The portable air conditioner as in claim 1, wherein said auxiliary exchanger is distinct with respect to said condenser.

7. The portable air conditioner as in claim 1, wherein said auxiliary exchanger and said condenser are combined.

8. The portable air conditioner as in claim 1, wherein said auxiliary exchanger and said condenser are made in a single body, but with two distinct circuits.

9. The portable air conditioner as in claim 1, wherein said auxiliary exchanger and said condenser have pipes with identical sections and/or said auxiliary exchanger and said condenser have pipes with identical areas of transit.

10. The portable air conditioner as in claim 1, wherein said auxiliary exchanger and said condenser have pipes with different sections and/or said auxiliary exchanger and said condenser have pipes with different areas of transit.

11. The portable air conditioner as in claim 1, wherein heat disposal means of said auxiliary exchanger has characteristics identical to heat disposal means of said condenser.

12. The portable air conditioner as in claim 1, wherein heat disposal means of said auxiliary exchanger has characteristics different from heat disposal means of said condenser.

13. The portable air conditioner as in claim 1, comprising a tank containing water, the tank being located adjacent a bottom of the portable air conditioner.

14. The portable air conditioner as in claim 1, wherein, once the gas has exited the condenser, the gas flows toward the expansion member in the form of a throttling valve, where the gas expands before entering the evaporator.

* * * * *